United States Patent [19]

Hlusko

[11] Patent Number: 4,510,842

[45] Date of Patent: Apr. 16, 1985

[54] MANUALLY OPERABLE RESIZING CARTRIDGE PRESS AND METHOD FOR OPERATING SAME

[76] Inventor: Edward G. Hlusko, 5312 Marlinton Dr., Virginia Beach, Va. 23462

[21] Appl. No.: 524,334

[22] Filed: Aug. 18, 1983

[51] Int. Cl.[3] ..... F42B 33/10; F42B 35/02

[52] U.S. Cl. ..... 86/25; 86/24; 86/28; 86/39; 86/40

[58] Field of Search ..... 86/25, 28, 36, 32, 39, 86/40, 24

[56] References Cited

U.S. PATENT DOCUMENTS

| | | | |
|---|---|---|---|
| 2,550,973 | 5/1951 | Corcoran | 86/24 |
| 2,571,272 | 10/1951 | Martin | 86/24 |
| 2,807,186 | 9/1957 | Veum | 86/23 |
| 2,825,259 | 3/1958 | Novak | 86/36 |
| 3,001,436 | 9/1961 | Deitemeyer | 86/25 |
| 3,157,086 | 11/1964 | Bachhuber | 86/27 |
| 3,283,643 | 11/1966 | Mittelsteadt | 86/36 |
| 3,580,127 | 5/1971 | Lee | 86/24 |
| 3,693,497 | 9/1972 | Jacobitz | 86/28 |
| 3,705,515 | 12/1972 | Lee | 86/24 |
| 3,771,411 | 11/1973 | Hazel | 86/27 |
| 3,796,127 | 3/1974 | Deitemeyer | 86/36 |
| 4,133,248 | 1/1979 | Phillips | 86/36 |
| 4,177,711 | 12/1979 | Lee | 86/38 |
| 4,189,980 | 2/1980 | Schaenzer | 86/24 |
| 4,325,282 | 4/1982 | Schaenzer | 86/24 |

*Primary Examiner*—Stephen J. Lechert, Jr.
*Assistant Examiner*—Howard J. Locker
*Attorney, Agent, or Firm*—Sandler & Greenblum

[57] ABSTRACT

A method and apparatus for resizing a spent firearm cartridge using a press for reshaping the cartridge is disclosed. The press includes a base block, two parallel rods vertically positioned transversally with respect to said block, and a pressure bar slidably attached to the rods. A U-shaped handle operates the pressure bar to force a cartridge into a die, and thereafter removing the cartridge from the die.

16 Claims, 5 Drawing Figures

MANUALLY OPERABLE RESIZING CARTRIDGE PRESS AND METHOD FOR OPERATING SAME

BACKGROUND OF THE INVENTION

1. Field of the Invention

The invention relates to a hand-operable press for resizing spent rifle and pistol cartridges, prior to their being primed and recharged with a bullet, and to a method of using the press to resize the cartridges.

2. Discussion of Prior Art

When a cartridge is fired in a rifle or pistol, the firing pin of the gun compresses the primer of the cartridge, which in turn causes the primer to ignite. The primer then ignites the main powder charge of the cartridge, thereby generating pressure which expands the metallic, e.g., brass, cartridge until it reaches the interior diameter of the gun chamber, thus sealing the chamber for a more efficient expulsion of the bullet.

After the bullet exits from the gun barrel, the pressure decreases, allowing the cartridge to contract slightly toward its prefiring size. The cartridge, however, does not completely return to its size, and thus cannot be reused unless it is reshaped.

In order for the spent cartridge to be reused, its walls must be contracted (i.e., resized) to its original prefiring size, any spent primer must be ejected from the cartridge, a new primer must be inserted into the cartridge, new powder must be added, and the bullet must be replaced.

Cartridge resizing and reloading devices have previously been developed. The patent to SCHAENZER, U.S. Pat. No. 4,325,282, discloses a hand-operated device for reloading and resizing cartridges. The resizing is accomplished by placing a resizing die vertically over a spent cartridge and tapping the top surface of the die with a rubber mallet until the die is forced over the cartridge and the cartridge is resized to the dimensions of the bore of the die. Once the cartridge has been shaped, an elongated rod is inserted into the bore of the die through the mouth of the cartridge and is tapped with a rubber mallet until the cartridge is freed from the die.

HAZEL, U.S. Pat. No. 3,771,411, also discloses a manually operable cartridge loading and resizing device. The device prepares a spent shotgun cartridge for reloading by inserting an empty cartridge onto a loading ram, and by then lowering a punch into the cartridge, which punches out the spent primer. Thereafter, the cartridge is resized by forcing a resizing die over the cartridge so that it is compressed within the bore of the die.

DEITEMEYER, U.S. Pat. No. 3,001,436, discloses a soft-shell loader and cartridge resizing press comprising a substantially horizontal base portion having upright standards and a supply support. The support includes a resizing and crimping tool which is reciprocable within a vertical bore. In order to resize a cartridge, a shell is placed above a metallic ring, and the handle is rotated towards the base of the device in order to compress the shell into the desired shape.

LEE, U.S. Pat. No. 4,177,711, discloses a shotgun loading device in the form of a press. The press includes a base having an upstanding column and a reciprocable arm and handle. To reshape a cartridge, a ram element with a central pin is used to force a ring over a shell. The pin pushes the primer from the cartridge.

BACHHUBER, U.S. Pat. No. 3,157,086, discloses a shell reloading device with a vertically reciprocable carriage. A tool having a pair of sizing dies is attached to the carriage, and is operator-activated via a handle and lever.

VEUM, U.S. Pat. No. 2,807,186, discloses a shotgun shell reconditioning press. It is capable of resizing a shell by using a cylindrical die to encase a shell. An operating handle is used to manipulate the resizing case and the knockout assembly.

None of the prior art, however, discloses a cartridge resizing press which can operate at relatively low volumes for resizing cartridges in as simple and efficient a manner as the present invention. Nor is any of the prior art capable of providing a temporary, e.g., tabletop, operation, or a permanently mounted operation as in the present invention.

SUMMARY OF THE INVENTION

Accordingly, it is a general object of the present invention to provide a new and improved manually operable press which overcomes the deficiencies of known cartridge resizing presses, and which provides for the resizing/reshaping of spent cartridges in an efficient and relatively inexpensive manner.

It is a further object of the present invention to provide a firearm cartridge press which can be used by individuals and others in a relatively low-volume operation in order to inexpensively, yet expeditiously, resize spent cartridges for further use.

The present invention comprises a manually operated press for forcing a spent firearm cartridge into a resizing die having a bore diameter which is appropriate to a desired caliber of cartridge, such as provided in commercial kits, e.g., the reloading kit manufactured by the Lee Company of Lee Precision, Inc. Hartford, Wis. 53027. Different size dies are used depending on the caliber of the cartridge selected. Generally, the press comprises a base in the form of a block having a hole bored therethrough, the diameter of the hole or aperture being greater than that of the cartridge to be resized. The press also includes a die which is adapted to be placed on the upper surface of the block over the aperture therein. The die has a bore diameter which is appropriately selected for resizing a cartridge to a desired caliber. The device also includes a hand-operable pressure-applying means for forcing a spent firearm cartridge into the die as well as means for removing the resized cartridge from the die after it has been forced into the same. The pressure is operated by a generally U-shaped handle, the U-shaped handle being attached to a pressure bar. The pressure bar moves in a substantially vertical direction along parallel guide rods which are securely attached and substantially perpendicular to the upper surface of the base of the press. The invention also provides means for ejecting the cartridge from the die.

More specifically, the present invention is provided for in a first aspect thereof by a die press for resizing variously sized and configured spent firearm cartridges for reuse. The press includes a base in the form of a block having an aperture bored therethrough. The diameter of the aperture is greater than that of the cartridges to be resized. The press also includes a die adapted to be positioned on the block and above the aperture, the die comprising means for receiving and positioning a cartridge to be resized. A hand-operable means for forcing one of the cartridges into the bore of the die in order to appropriately resize the cartridge for reuse is provided, as are means for removing the resized cartridge from the die.

The present invention is provided for in a second aspect thereof by a die press for resizing spent firearm cartridges. The press includes a rectangular block, one end of the block having a generally cylindrical bore hole of a diameter which is greater than that of the cartridges to be resized. The hole is bored completely through the block. A back brace is attached to one block end and is angled forwardly in the direction of the end of the block opposite to the one end and upwardly from an upper surface of the block. A flat, generally rectangular plate is attached to the brace above the block and in a substantially parallel fashion to the upper surface of the block. Two thin, cylindrical guide rods are bolted in substantially parallel, vertical fashion to the top surface of the block and on either side thereof, equidistant from, and colinear with, the bore hole, the rods being fastened at top ends thereof to the flat, rectangular plate. A pressure bar comprising means for forcing a spent cartridge into and through a die comprises a thin, rectangular bar having one cylindrical aperture therethrough at each of its ends. Reinforcing sleeves are inserted into the cylindrical holes. The pressure bar is slidably mounted upon the guide rods which pass through the sleeves and the bar apertures. A generally U-shaped handle has arms fastened to the opposite ends of the rectangular pressure bar adjacent a respective end of each arm. The arms which also have apertures therein at a point located closer to a respective arm end than to the point of fastening of the arm to the bar. Connecting rods are pivotably mounted to the arm apertures at one end and to sides of the block at their other ends. A generally cylindrical die having a central bore with a diameter selected to produce a resized cartridge is adapted to be positioned along the upper surface of the block so that the bore of the die is positioned directly above and co-axially with the block bore hole. A cartridge extractor rod comprises means for removing the cartridge from the die after it has been sized.

In a third aspect thereof, the present invention is provided for by a method for resizing spent firearm cartridges which includes inserting the open end of a spent firearm cartridge into a die. The bore of the die is a diameter which is appropriate for resizing the cartridge to a desired caliber. The method further comprises forcing the spent cartridge into the bore of the die by manually applying downward, substantially vertical pressure upon means for forcing the cartridge into the bore until the forcing means contacts the back surface of the cartridge and forcibly pushes the cartridge into the bore. The method also includes removing the resized cartridge from the die.

The above and other objects, features, and advantages of the present invention will become more fully apparent to one of ordinary skill in the art to which the invention pertains from the following detailed description, taken in conjunction with the accompanying drawings.

BRIEF DESCRIPTION OF THE DRAWINGS

All of the above advantages and features of the above invention are clearly illustrated in the drawings attached hereto, in which like reference numerals represent like parts throughout, and wherein.

DETAILED DESCRIPTION OF THE DRAWINGS

Figure 1:
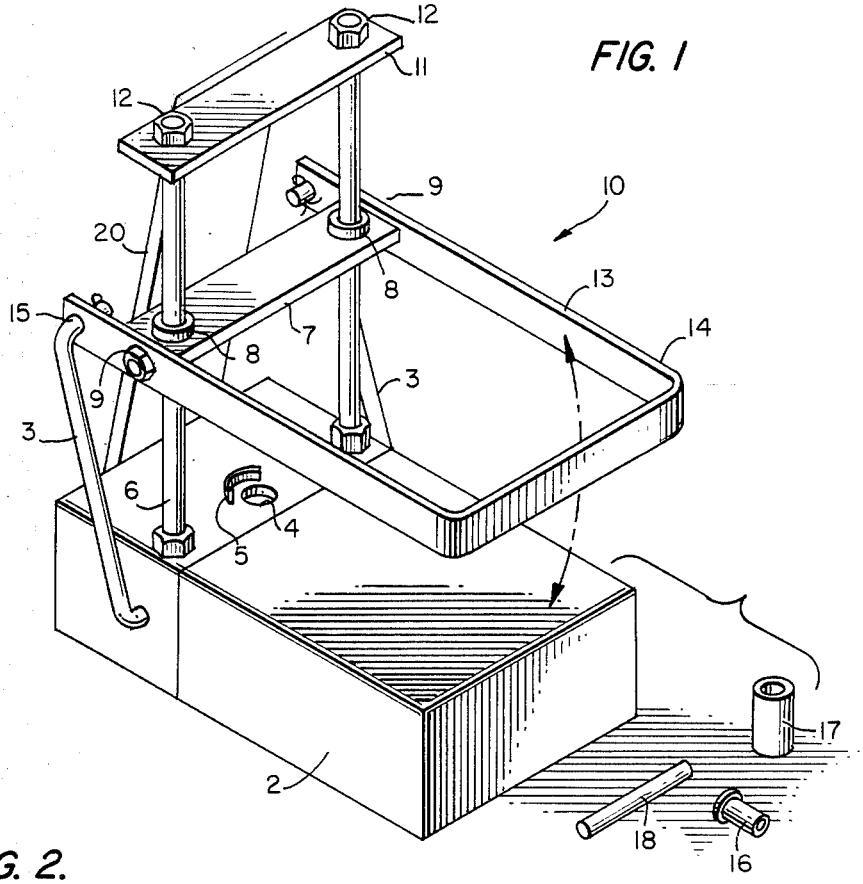
FIG. 1 is a perspective view of a resizing press formed in accordance with the present invention.

The present invention is shown in detail in the drawings. Press 1 is mounted on a generally rectangular base 2, which is substantially parallelepipedic. The block has a substantially flat upper surface having a generally cylindrical bore hole 4 adjacent one end thereof. Positioned adjacent to the bore hole, and extending upwardly from the upper surface of the block, is a generally arcuate stop 5. As will be explained later, the die stop cooperates to properly position a die into which a cartridge may be resized. Adjacent the upper end of the surface of the block are a pair of substantially vertically arranged, parallel guide rods 6. The rods are located in equidistant fashion on opposed sides of the bore hole 4. The rods are attached to the upper surface of the block in a conventional fashion, e.g., by the nuts shown in FIG. 1, or by insertion into additional apertures on the top of block 2.

One of the ends of the block has a supporting back brace attached thereto. The back brace, as shown in FIG. 1, includes a substantially flat plate 10 which is positioned adjacent to one end of the block and which is angled upwardly and forwardly from the end of the surface of the block adjacent to arcuate positioning element 5.

The upper ends of rods 6 are attached to a generally rectangular plate 11, as is best shown in FIG. 1. Again, the means for attaching the upper plate to the rods can be conventional, e.g., nuts 12 attached to threaded upper ends of rods 6. The upper end 21 of plate 10 is attached to plate 11; this attachment can be integral or, e.g. by welding.

Figure 2:
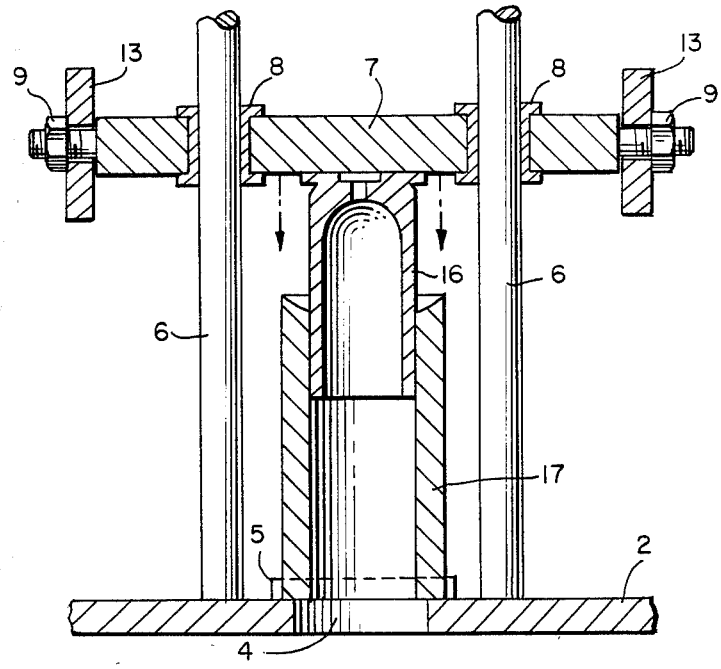
FIG. 2 is a sectional view of the press of FIG. 1 with a cartridge being inserted into a die positioned on the upper surface of the press block.

Pressure bar 7, which is used in forcing a cartridge into a die and in ejecting a resized cartridge from the die, is located in a substantially vertical position between the upper surface of block 2 and plate 11. The pressure bar 7 is substantially thin, rectangular element having two apertures therein. Each of the apertures accomodates a sleeve or other conventional reinforcing element and is adapted to slidably receive a respective end of guide rods 6. Pressure bar 7 is slidably moved along rods 6 by hand-manipulable, generally U-shaped handle 14. This handle includes two generally flat, parallel arms 13. Near one end of each arm, an aperture is provided therein, as best shown in FIG. 2, to receive a fastening member 9 of conventional construction. This serves to rigidly connect the U-shaped handle to the ends of pressure bar 7. If necessary, the ends of bar 7 can be bored to receive members 9. The arms are also provided with a second aperture, closer to the ends thereof, through which one end of a respective rod 3 is attached. The pivotal connecting rods are inserted through holes 15 at the end of each arm, and are adapted to be secured in pivotal fashion to the ends of the arms by conventional means, e.g., by a wing nut. The other ends of connecting rods 3 are pivotably attached to the block, also in conventional fashion.

Each rod 3 comprises a generally cylindrical rod, the ends of which have been bent in a substantially perpendicular fashion with respect to the remaining longitudinal portion of the rod. The ends are bent in the same direction transversally to the rod.

Figure 3:
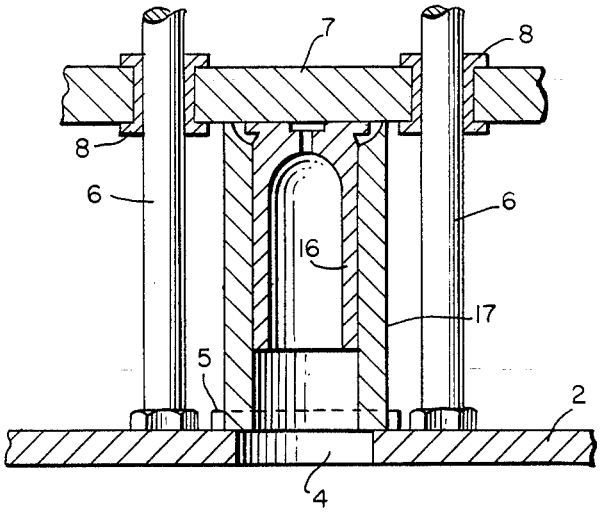
FIG. 3 is a view of the press similar to that of FIG. 2 but showing the cartridge fully positioned within a die along the upper surface of the base.

Operation of the device in resizing a spent firearm cartridge can be best explained with respect to the illustrations in FIGS. 1-15. As best shown in FIG. 2, a cartridge to be resized is initially placed, insofar as possible, within one end of cartridge die 17. At this point, operation of the press is initiated by depressing handle 14 in the direction shown by the lower arrow in FIG. 1. Pressure is exerted only after the cartridge and die are positioned adjacent to base bore hole 4 by means of arcuate guiding structure 5. As handle 14 is depressed towards the upper surface of base 2, pressure bar 7 is forced towards upper surface the base 2; pressure bar 7 exerts pressure downwardly on the substantially closed end of cartridge 16. This forces the cartridge into the interior of the die, thus compressing and resizing the cartridge as best illustrated in FIG. 2. FIG. 3 illustrates the operation of the device when it is substantially complete, and when the cartridge is wholly within the die.

Figure 4:
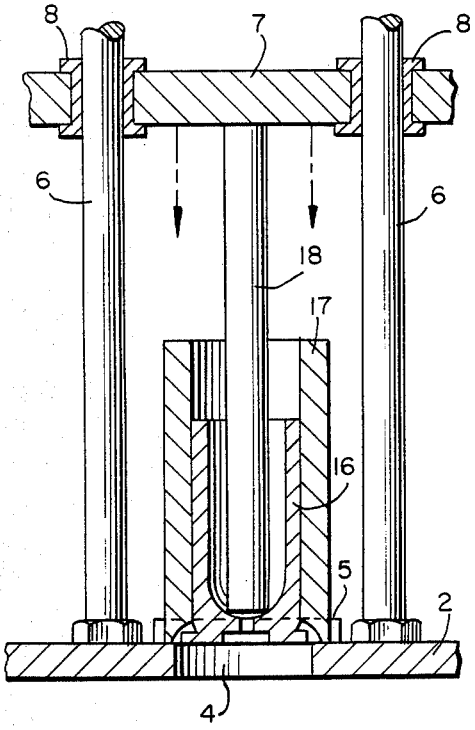
FIG. 4 is a sectional view similar to those of FIGS. 2 and 3, but taken after the cartridge and die have been inverted in order to illustrate the initial step in removing the resized/reshaped cartridge from the die.

After the cartridge is resized, handle 14 is raised, and the die and cartridge are inverted, so that the open mouth of the cartridge faces upwardly, as best illustrated in FIG. 4.

Figure 5:
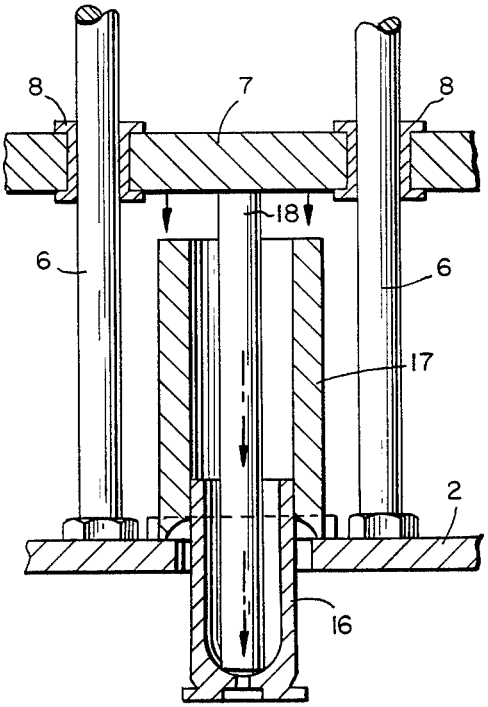
FIG. 5 is a sectional view similar to that of FIG. 4 illustrating the step of forcing the cartridge from the die in which the cartridge appears to have been completely extracted from the die.

At this point a cartridge ejector rod 18 is utilized to remove/eject resized cartridge 16 from cartridge die 17. As handle 14 is again depressed, again in the direction of the lower arrow illustrated in FIG. 1, pressure bar 7 is forced downwardly and comes into abutment with ejector rod 18. Pressure bar 7 thus operates upon the ejector rod to force the resized cartridge outwardly from the die and through bore hole 4, as best seen in FIG. 5. Cartridge 16 has then been reformed, and need only be reprimed and reloaded with a bullet in conventional fashion.

The relationship between the operation of handle 14 and bar 7 is evident. Power bar 7 is lowered via downward movement of the handle because of the movement of connecting rods 13 in a substantially downward, pivotal position.

Ideally, a number of different sized dies are associated with press 1, so that different caliber cartridges can be resized. As noted, such dies are commercially available, so that the inventive press is extremely versatile and can be employed with cartridges of all sizes.

Although the invention has been described and depicted in the drawings with reference to specific elements, it must be understood that the invention is not limited to the particulars disclosed and extends to all equivalents within the scope of the claims.

What is claimed is:

1. A die press for resizing variously sized and configured spent firearm cartridges for reuse, said press comprising:

(a) a base comprising a block having an aperture bored therethrough, the diameter of said aperture being greater than that of the cartridges to be resized;

(b) a die adapted to be positioned on said block and above said aperture and comprising means for receiving and positioning a cartridge to be resized;

(c) hand-operable means including a thin rectangular pressure bar having two ends, said bar comprising forcing means for supplying substantially vertical downwardly directed force to one of said spent cartridges to thereby force said spent cartridge into the bore of said die so as to resize appropriately said cartridge for reuse; and (d) means for removing said resized cartridge from said die.

2. A die press according to claim 1 wherein said block is parallelepipedic and said aperture is bored along an upper surface thereof.

3. A die press according to claim 2 wherein said pressure bar having two ends, an aperture being located at each of said ends, said pressure bar being spaced vertically above and substantially parallel to said upper block surface.

4. A die press according to claim 3 further comprising a back brace attached to one end of said block, said one end being adjacent to said block aperture, said back brace comprising a substantially flat plate which is angled upwardly over said block at said one end thereof.

5. A die press according to claim 4 further comprising a flat, thin plate attached to a top portion of said back brace and positioned substantially parallel to the upper surface of said block.

6. A die press according to claim 5 wherein two thin, substantially cylindrical connecting rods are attached in a substantially vertical fashion to said block, on respective sides of, and equidistant from, said block aperture, said rods being fastened at the top ends thereof to the ends of said flat plate, said rods passing through said bar apertures.

7. A die press according to claim 3 further comprising sleeves for attaching cylindrical rods to said bar.

8. A die press according to claim 7 wherein said forcing means includes a generally U-shaped handle, said handle having two arms, each said arm being fastened to one side of said rectangular pressure bar, each of the ends of said handle being pivotably connected to connecting rods which are pivotably mounted to respective sides of said block.

9. A die press according to claim 8 wherein an arcuate die stop is positioned on the upper surface of said block adjacent to said block aperture, said die stop thereby comprising means for positioning a die on said block's upper surface.

10. A die process according to claim 3 wherein said removing means comprises a generally cylindrical extractor rod adapted to be pushed by said pressure bar into said die.

11. A die press for resizing spent firearm cartridges, said press comprising:

(a) a parallelepipedic block, one end of said block having a generally cylindrical bore with a diameter greater than that of the cartridges to be resized;

(b) a back brace attached to said block adjacent to said one end of said block, said brace being angled forwardly in the direction of the end of the block opposite to said one end and upwardly from the upper surface of said block;

(c) a flat, generally rectangular plate attached to said brace above said block and substantially parallel to the upper surface of said block;

(d) two thin cylindrical guide rods bolted in substantially parallel, vertical fashion to the top surface of said block on either side thereof, equidistant from and colinear with said block bore, said rods being fastened at top ends thereof to said rectangular plate;

(e) a pressure bar comprising means for forcing a spent cartridge into and through a die, said pressure bar comprising a thin rectangular bar having one cylindrical aperture therethrough at each of its ends, reinforcing sleeves being inserted in said cylindrical apertures, said pressure bar being slidably mounted upon said guide rods which pass through said sleeves and said bar apertures;

(f) a U-shaped handle, each arm of which is fastened to an end of said rectangular pressure bar adjacent to respective ends of said arms, said arms having apertures therethrough which are closer to said arm ends than to the fastening points of said arms to said bar;

(g) connecting rods, each rod pivotably mounted to said arm apertures at one end and to sides of said block at a second end;

(h) a generally cylindrical die having a central bore with a diameter selected to produce a resized cartridge, said die adapted to be positioned on the upper surface of said block so that the bore through said die is directly above and co-axial with said block bore hole; and (i) a cartridge extractor rod comprising means for removing the cartridge from said die after it has been resized.

12. A die press according to claim 11 wherein said flat rectangular member is integrally connected to said back brace.

13. A die press according to claim 11 wherein the upper surface of said block includes an arcuate ridge positioned about said bore hole for seating said cylindrical die above said hole and for stabilizing said die on said upper block surface.

14. A method for resizing spent firearm cartridges comprising the steps of:

(a) inserting the open end of the spent cartridge into a die, said die having a diameter appropriate for resizing the cartridge to a desired caliber;

(b) forcing a spent cartridge into the bore of said die by manually applying downward pressure upon a thin rectangular pressure bar to supply substantially vertical downwardly directed force to the base of said cartridge and to forcibly push said cartridge into said bore; and (c) removing said resized cartridge from said die.

15. A method according to claim 14 wherein said resized cartridge is removed from said die by inverting said die with said cartridge therein so that the open end of the cartridge points upwardly, placing said die upon a block having a hole bored therethrough, the diameter of said hole being greater than that of said cartridge but less than that of said die, so that the cartridge is situated directly above the hole in said block, inserting an extractor rod having a length greater than that of the cartridge into said open end of said cartridge until it abuts an end of said cartridge, manually applying downward pressure to said pressure bar which contacts the end of said extractor rod which protrudes from said cartridge, said extractor rod thus forcing said cartridge out of said die and through the hole in said block, and removing said cartridge from beneath said upper block surface.

16. A method according to claim 15 wherein pressure is applied to said bar by manually applying pressure to a U-shaped handle which is attached to the bar.

* * * * *